US007727043B2

(12) United States Patent
Whitaker

(10) Patent No.: US 7,727,043 B2
(45) Date of Patent: Jun. 1, 2010

(54) CURLING STRUCTURE FOR A SIMULATED AQUATIC CREATURE AND THE LIKE

(75) Inventor: Dawn Whitaker, Pasadena, CA (US)

(73) Assignee: MGA Entertainment, Inc., Van Nuys, CA (US)

( * ) Notice: Subject to any disclaimer, the term of this patent is extended or adjusted under 35 U.S.C. 154(b) by 641 days.

(21) Appl. No.: 11/731,087

(22) Filed: Mar. 30, 2007

(65) Prior Publication Data

US 2007/0254556 A1 Nov. 1, 2007

Related U.S. Application Data

(60) Provisional application No. 60/745,746, filed on Apr. 26, 2006.

(51) Int. Cl.
*A63H 23/10* (2006.01)
*A63H 23/00* (2006.01)

(52) U.S. Cl. ..... 446/156; 446/330

(58) Field of Classification Search ..... 446/153–159, 446/330, 351–353, 368
See application file for complete search history.

(56) References Cited

U.S. PATENT DOCUMENTS 1,928,418 A 9/1933 Garland
2,645,883 A 7/1953 DeSalvo
2,648,935 A 8/1953 Nagel
2,909,868 A 10/1959 Lewis
3,785,084 A 1/1974 Aenishanslin
3,808,734 A 5/1974 Suzuki
3,835,581 A * 9/1974 Grieder ..... 446/158
4,135,326 A 1/1979 Tong
4,713,037 A 12/1987 Tong
4,832,650 A 5/1989 Tong
5,344,357 A 9/1994 Lyczek
5,931,715 A 8/1999 Chang
6,135,848 A * 10/2000 Hou ..... 446/353
6,431,941 B1 * 8/2002 Frawley et al. ..... 446/330
6,773,327 B1 8/2004 Felice et al.

* cited by examiner

*Primary Examiner*—Kien T Nguyen
(74) *Attorney, Agent, or Firm*—Intellectual Property Law Offices of Joel Voelzke, APC

(57) ABSTRACT

A curling structure for use in mechanical swimming creatures and the like includes a series of jointed segments pivotally connected together, with cross members pivotally connected between non-adjacent segments. Each cross member has its first end pivotally connected to a given segment above the pivot point connecting that segment to an adjacent segment, and its second end connected to a non-adjacent segment below the pivot point which connects that non-adjacent segment to the next segment. The result is that as one segment pivots about the joint connecting it to an adjacent segment, the cross members cause all of the segments to curl in a single direction.

19 Claims, 3 Drawing Sheets

CURLING STRUCTURE FOR A SIMULATED AQUATIC CREATURE AND THE LIKE

CROSS-REFERENCE TO RELATED APPLICATIONS

This application claims priority from U.S. provisional patent application No. 60/745,746 filed Apr. 26, 2006.

BACKGROUND OF THE INVENTION

1. Field of the Invention

This invention relates to a positioning mechanism. More particularly, the present invention relates to a structure for causing a number of jointed segments to curl together such as to simulate the swimming motion of an aquatic creature.

2. Description of Related Art

Small children who resist taking their baths can represent formidable foes for their parents. In order to help make bath time fun and enjoyable, and to provide general entertainment for children in the bathtub or the swimming pool, a number of toys have been introduced, including various powered swimming toys with the power being provided by windup springs, rubber bands, batteries, or the like. A number of mechanisms have been proposed for implementing mechanical fish tails, or other appendages of aquatic creatures such as mermaids, dolphins, and whales, for use in bath and swimming pool toys. Many of those mechanism rely on one or two flexible tendon-like rods or wires running down the length of the tail and offset from the center of a flexible or jointed mechanical frame, with the rods being pushed and/or pulled relative to the frame in order to induce a back and forth movement in the tail similar to the swimming motion of a real fish.

U.S. Pat. No. 6,773,327 issued to Felice et al. discloses such a mechanism. In Felice's structure, a rotating lever pulls on an elongated tendon-like device which extends down the length of a jointed and ribbed structure to cause that structure to curl. Structures that employ generally similar principles include U.S. Pat. No. 1,928,418 issued to Garland; U.S. Pat. No. 2,648,935 issued to Nagel; U.S. Pat. No. 5,297,443 issued to Wentz; U.S. Pat. No. 5,931,715 issued to Chang; and U.S. Pat. No. 6,458,010 issued to Yamagishi et al.

SUMMARY OF THE INVENTION

The present invention provides a novel curling or positioning mechanism which may be used to curl an appendage in a simulated living thing. As one non-limiting example, the present invention can be used in the tail section of a mechanical mermaid to simulate a swimming motion of the mermaid's tail, although those skilled in the mechanical engineering arts will recognize that the present invention can be used in many applications in which is it desired to induce a curling action in a structure. Advantages of the present mechanism include that the mechanism is simple to manufacture and assemble, and allows a simple mechanical interface to a drive motor to induce a unidirectional curling motion throughout a number of interconnected joint segments, first in one direction and then in the opposite direction. The present invention will be described with reference to one illustrative embodiment in which the mechanism effects a swimming motion in the tail of a mechanical mermaid. The example is used for illustration purposes only, and the invention is not confined to the example given.

In the illustrative embodiment, a mechanical mermaid's torso contains a power source such as a battery and a motor powered by the battery. A first segment defining a first jointed segment is pivotally connected to the torso. One or more additional jointed segments are pivotally connected in series beginning with the first segment, such that a number of segments are all connected in series with each segment being pivotally connected to an adjacent segment at a first end closest to the torso (the proximal end of the segment), and also pivotally connected to another adjacent segment at its tail end (the distal end of the segment). A series of cross members or control links pivotally connect together non-adjacent ones of the segments. For each cross member, a first end is connected to one segment below the longitudinal axis of the curling structure defined by a line drawn through the pivot points which connect the joined segments together, and a second end is connected to a non-adjacent segment above that longitudinal axis. When the first segment is rotated upward toward the torso, a control link between the torso and the second segment pulls on the second segment thus causing it to also rotate upward and backward toward the torso. A second control link running from the first segment to a third segment in turn pulls backward on the third segment, thus causing the third segment to rotate upward and backwards toward the torso. The result is that the entire structure curls upward and backward toward the torso in the same rotational direction.

In a similar fashion, when the first segment is rotated downward and toward the torso, the control links in turn push on the segments to which they are connected, thus causing the entire structure to curl downward and backward. In this way a simple rotational movement of the first segment adjacent to the torso causes all of the other segments to curl in the same direction as the first segment. When the first segment is caused to rock back and forth by operation of the motor, the structure curls first in one direction and then in the other, thus creating a motion that is similar to the tail motion of a swimming aquatic creature.

An important aspect of the invention is that the control links are not parallel, i.e., they are skew, to the line between the pivot points between segments which define the longitudinal axis of the mechanism. Because the links are skew to that line, as one segment is rotated relative to its adjacent section, the associated control link will either push or pull on the next segment down the line, which will cause that segment to rotate in the same direction. In the preferred embodiment the control links cross the longitudinal axis in a regular diagonal pattern, although it is not strictly necessary that the control links cross over the longitudinal axis nor that the control links have a regular pattern. It would be possible to locate and attach the control links in such a fashion that a control link causes the next segment to rotate more than, or less than, the rotation of the first segment, or even for the next segment to rotate in the opposite direction as the first segment. In this way a segmented structure could be created in which, if one segment is displaced in one direction, the rest of the structure will remain pointing in the same general direction as previously.

Exemplary embodiments of the invention will be further described below with reference to the drawings, in which like numbers refer to like parts.

DETAILED DESCRIPTION OF THE PREFERRED EMBODIMENTS

Figure 1:
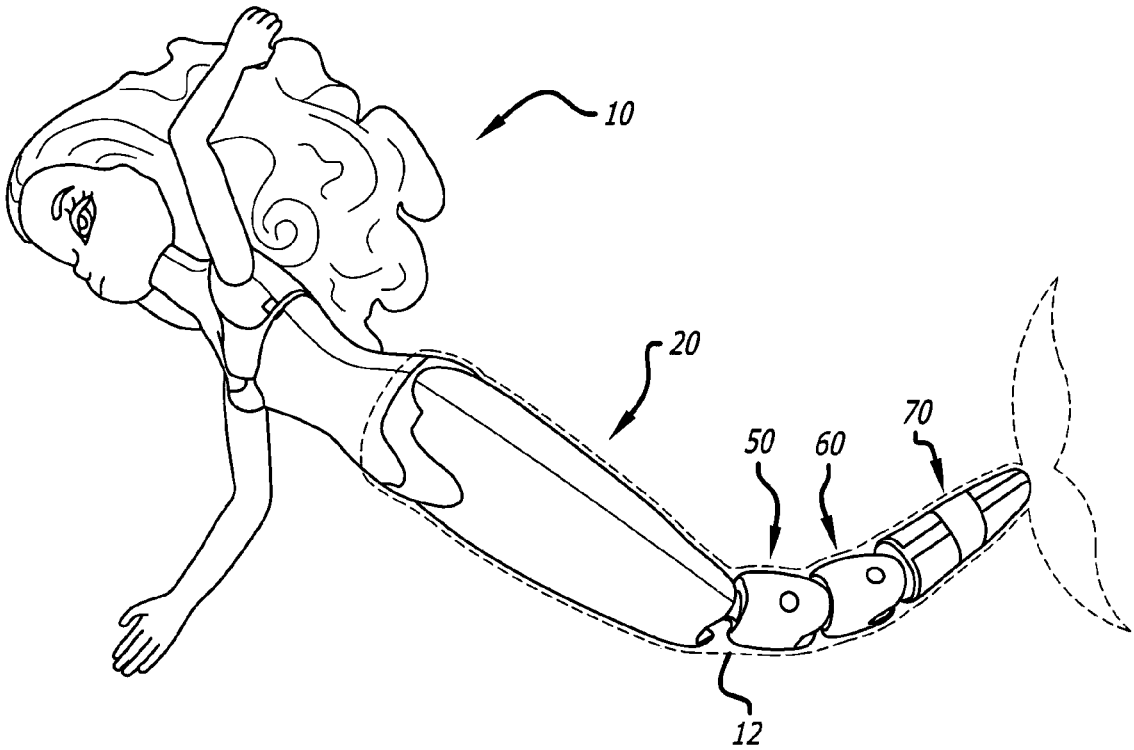
FIG. 1 is a perspective view of a mechanical mermaid having a tail movement mechanism according to an illustrative embodiment of the present invention.

FIG. 1 illustrates a mechanical, battery operated swimming mermaid bath or swimming pool toy constructed according to one illustrative embodiment of the present invention. Mermaid 10 includes a torso 20, a first rotating jointed segment 50, a second segment 60, and a distal most and third segment 70. A flexible elastomeric tail and skin, shown in outline, are fitted over the curling tail mechanism structure. Torso section 20 has housed within it one or more batteries (not shown) for providing power, a motor (not shown), and a reduction gear set (not shown). The battery and motor are contained within a watertight housing, which may include the reduction gear set as well. The components not shown are standard design components, and persons skilled within the relevant art will be able to select and/or design the necessary components.

Figure 2:
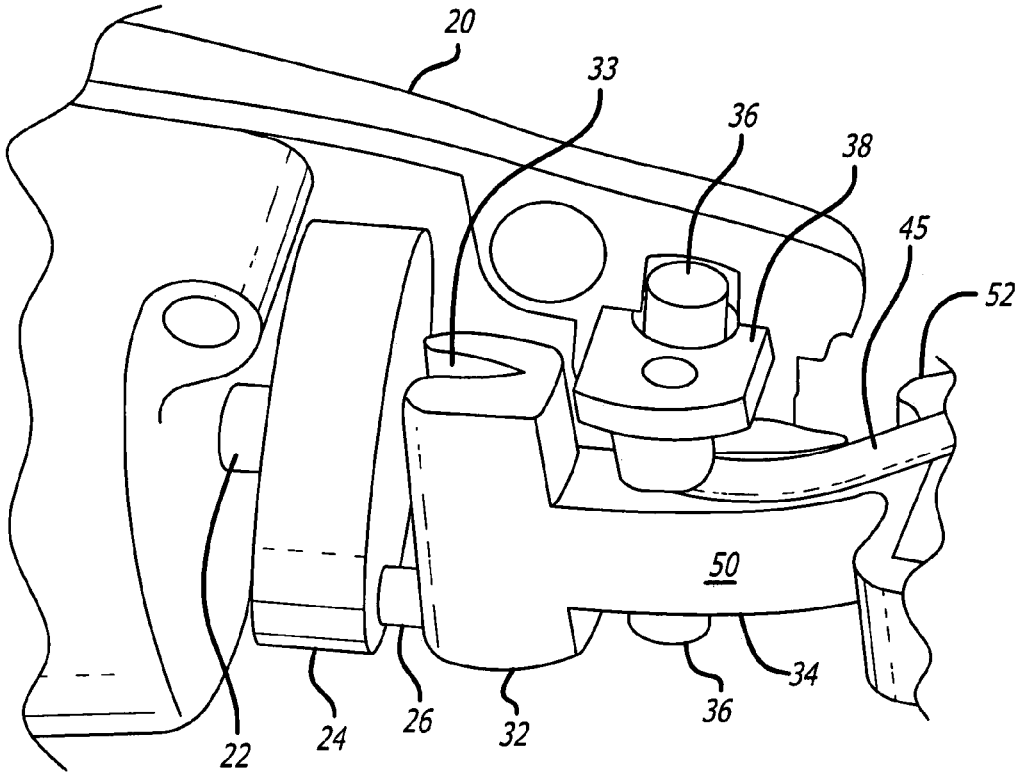
FIG. 2 is a perspective view of the coupling mechanism between a motor and the curling mechanism according to the embodiment.

FIG. 2 shows the distal end of torso section 20 with its cover removed to reveal the mechanical interface between the drive shaft and the tail curling structure. Drive shaft 22 protrudes from the reduction gear housing. Attached to drive shaft 22 is a rotating wheel 24 having a cylindrical knob 26. Knob 26 fits into a slot 33 formed in the proximal end 32 of first segment 50, which is attached to the distal end of first segment 50 via lever 34. Lever 34 is rotatably mounted to torso 20 by round pin 36. First cross member or control link 45 has an approximate 90 degree bend at its proximal end, which is rotatably attached to the torso by the bent end being fitted into a hole within control link support 38. As drive shaft 22 and wheel 24 rotate, knob 26 travels in circles, causing end 32 to rock up and down in an oscillating sinusoidal manner. This causes the distal end of first segment 50 to also rock up and down in the same manner as first segment 50 pivots on pin 36, which provides the axis of rotation for first segment 50.

Figure 3:
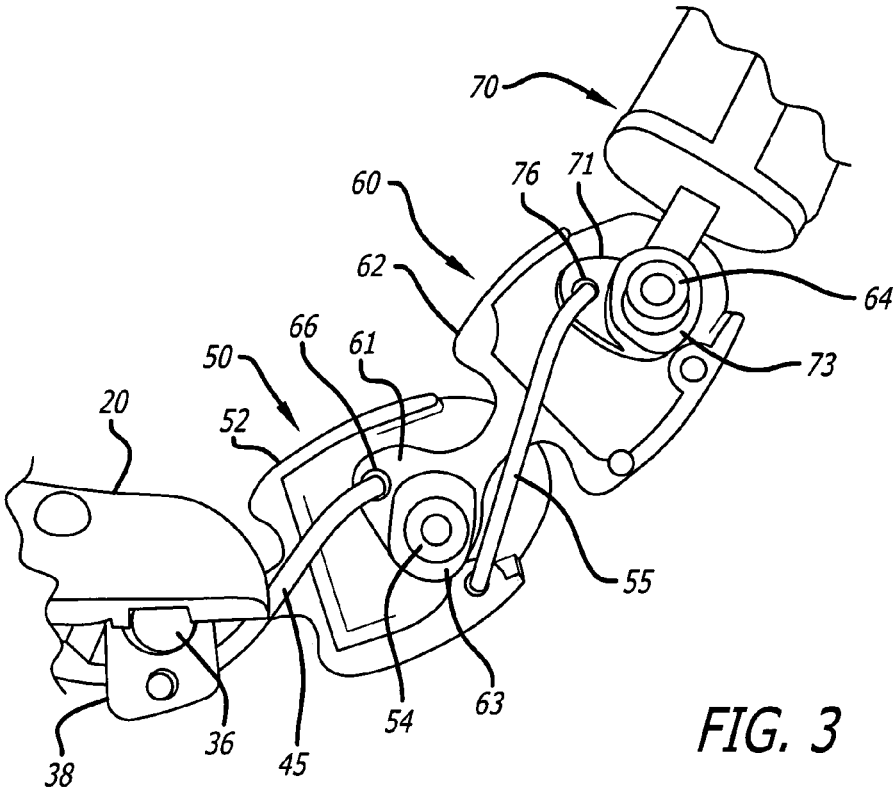
FIG. 3 is a top plan view of the mermaid's tail, showing the jointed segments of the tail uniformly curling in the counterclockwise direction.

FIG. 3 is a top plan view of the tail mechanism with the covers (not shown) of the torso 20, first segment 50, and second segment 60 removed, and with the structure curled upward in a counterclockwise curling motion. In the illustrative embodiment the covers of segments 50 and 60 are attached to the segments and held in place thereto via threaded screws (not shown) which screw into the center holes of cylindrical shafts 54 and 64.

Figure 5:
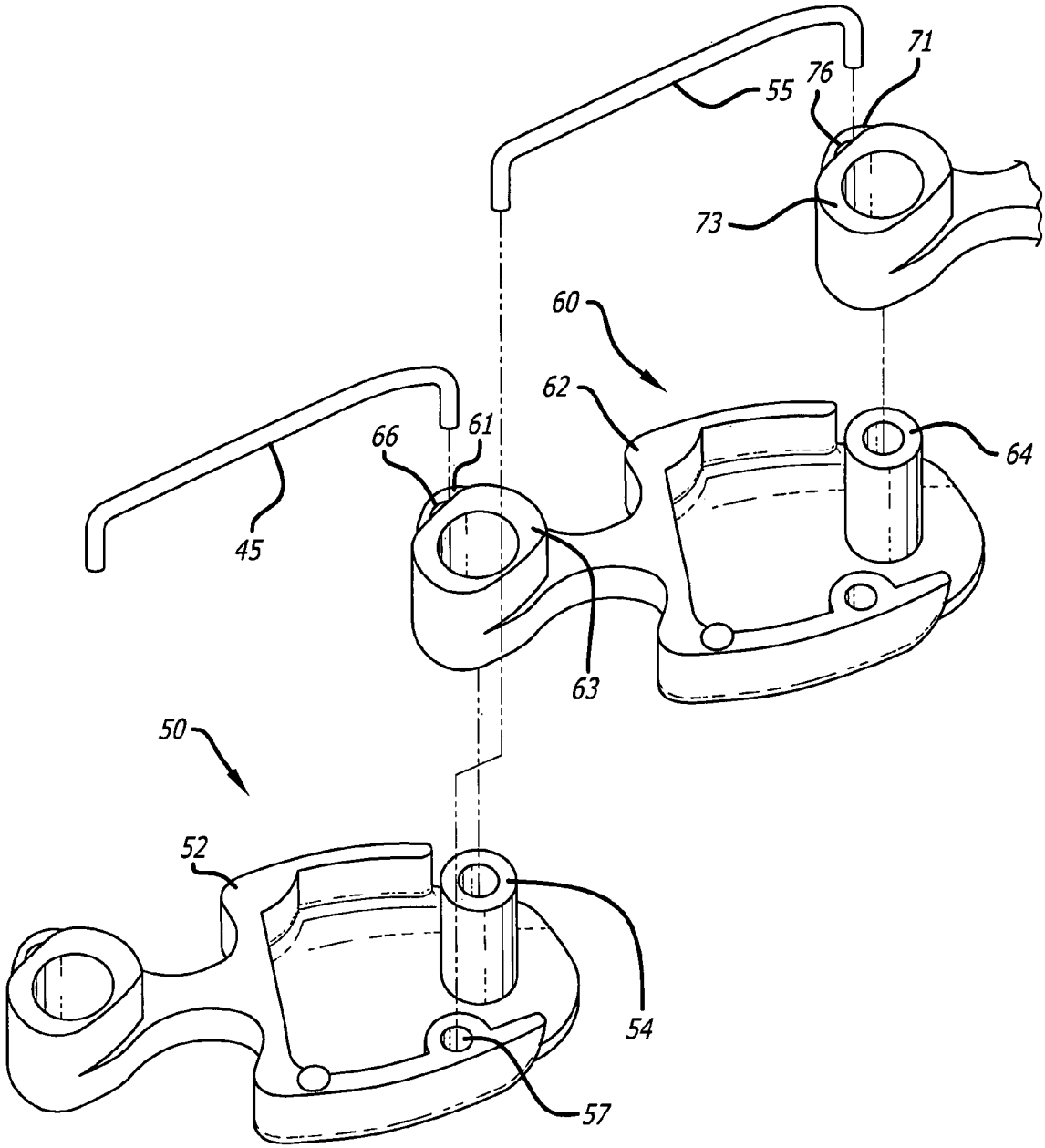
FIG. 5 is an exploded view of two of the jointed segments of the mermaid's tail and the control links that connect non-adjacent segments.

FIG. 5 is an exploded view that shows the details of the individual segments, and shows the way that the control links are mounted to the segments. Second segment 60 includes a pivot section 63 which receives cylindrical pivot pin 54 of first segment 50, a cylindrical pivot pin 64 received in hole 76 of third segment 70, and a lever portion 61 which has a hole 66 for receiving the bent distal end of first control link 45. As control link 45 pushes or pulls on lever portion 61, second segment 60 rotates downward or upward, respectively, relative to first segment 50 about cylindrical shaft 54. The proximal end of first control link 45 is fitted into control link support 38 attached to torso 20 (FIG. 1).

Second control link 55 has two ends bent at approximately 90 degrees for rotatably fitting into hole 57 in first segment 50, and into hole 76 in lever section 71 of third segment 70. Note that the control link therefore rotatably connects first segment 50 and non-adjacent third segment 70, but is not connected to second segment 60 across which it generally extends. A line between the two mounting points 57 and 76 defines a longitudinal axis of second control link 55. Similarly, first control link 45 has a longitudinal axis defined by the two points at which the control link is mounted.

Returning to FIG. 3, pin 36 defines a rotational axis of first segment 50. Similarly, cylindrical shafts 54 and 64 define the rotational axes of second and third segments 60 and 70, respectively. An imaginary line passing through the segments' axes of rotation defines a longitudinal axis of the tail. When the tail is straight, there is a single longitudinal axis passing through all of those pivot points.

In the figure as shown, slotted proximal end 32 (not shown) of first segment 50 is rotated toward the bottom of the figure, which has caused the distal end 52 of first segment 50 to rotate upwards about pin 36. First control link 45 is attached to torso 20 at support 38 and is attached to second segment 60 at hole 66. Because first control link 45 is connected skew to the longitudinal axis of the pivot points which link the segments together, the upward rotation of first segment 50 has caused first control link 45 to pull backwards on lever portion 61 of second segment 60, which caused second segment 60 to rotate upwards and counterclockwise relative to first segment 50. That is, second segment 60 acted upon by control link 45, has rotated in the same direction with respect to the first segment as the first segment rotated with respect to torso 20. Similarly, because second segment 60 has rotated upward relative to first segment 50, second control link 55, which is connected between first segment 50 at hole 57 and third segment 70 at hole 76 within lever section 71, has caused third segment 70 to rotate upward or counterclockwise with respect to second segment 60. The end result is that a movement of slotted end 32 has caused a ripple effect by which each segment within the mechanism has curled in turn in a single direction to impart a uniform curl throughout the mechanism.

Figure 4:
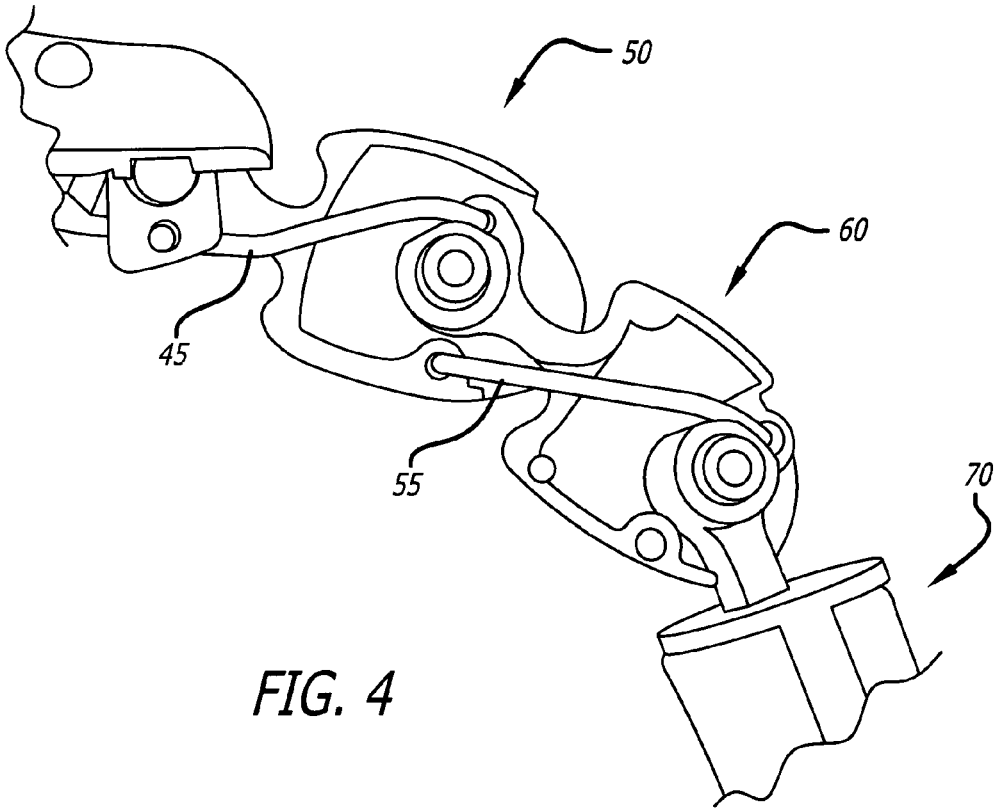
FIG. 4 is a top plan view of the mermaid's tail, showing the jointed segments of the tail uniformly curling in the clockwise direction.

FIG. 4 shows the mechanism curling uniformly downward and clockwise. In this figure, slotted end 32 (not shown) has been driven toward the top of the figure, which caused first segment 50 to rotate downward. This has caused first control link 45 to push on lever section 61 of second segment 60, which in turn rotated second segment 60 downward, which in turn caused third segment 70 to rotate downwards in response to a push on it from third control link 55.

The mechanism of the present invention has therefore caused a simple, oscillatory up-and-down or side-to-side movement at slotted end 32 to be translated into a uniform curl of the entire tail, first in one direction and then in the opposite direction, thus causing the mechanism to simulate the flopping back and forth motion of a fish tail and inducing a swimming action of the mermaid.

In the illustrative embodiment, the distal end of first control link 45 is mounted generally above the pivot point of the second segment, and the proximal end of second control link 55 is mounted generally below that same pivot point, such that when the curling mechanism is straight, a line drawn between the first control link's distal mounting point and the second control link's proximal mounting point defines a line that is generally perpendicular to the longitudinal axis of the curling mechanism and crossing through the pivot axis between two adjacent segments. Those structural details are not necessary to the practice of the invention, although arranging the control links to cross over the longitudinal axis of the mechanism and to be mounted at such points does produce a compact, simple, and efficient design for this particular application.

In an alternative embodiment, instead of the first segment being oscillated up and down to initiate the curling motion, the first control link could be pushed and pulled by action of the motor, thus initiating the rotation of one jointed segment relative to another. Although it is presently contemplated that a motor interface that causes the first segment to rock up and down in order to initiate curling action will generally be a simpler and thus preferred mechanism than one that pushes and pulls on a control link, there may be applications in which pushing and pulling on a first link may be preferred for various design reasons. Similarly, there are other ways to initiate a bending at the first segment, and the present invention contemplates use of such alternative mechanisms.

In FIGS. 3-5, second control link 55 is mounted to first segment 50 and to third segment 70 such that as second segment 60 is rotated counterclockwise relative to first segment 50, control link 55 pulls on lever portion 71 of third segment 70 to also cause it to rotate counterclockwise relative to second segment 60. That is, curling in a particular direction is propagated to successive segments. Instead of this arrangement, however, control link 55 could be mounted at different points on first segment 50 and on third segment 70 so as to cause a clockwise rotation of third segment 70 in response to a counterclockwise rotation of second segment 60. In such an arrangement, the action of the control links would make successive segments curl in the opposite direction. The result would be that the structure resists curling, rather than propagating curling, in response to angular displacement of any particular segment.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

I claim:

1. A curling mechanism comprising a first member;

a first segment rotatably connected to the first member at a first pivot axis;

a second segment rotatably connected to the first segment at a second pivot axis, the second pivot axis being disposed distally relative to the first pivot axis; and a first cross member rotatably attached to the first member at a first cross member first attachment point, and also rotatably attached to the second segment at a first cross member second attachment point, the first cross member having a first cross member longitudinal axis defined by said two attachment points;

wherein said first cross member longitudinal axis is skew to a line between the first and second pivot axes; and wherein rotational movement of the first segment relative to the first member causes the first cross member to exert a rotational force on the second segment relative to the first segment, thereby causing the second segment to rotate relative to the first segment.

2. The curling mechanism of claim 1 wherein:

the rotational force exerted on the second segment by the first cross member causes the second segment to rotate relative to the first segment in the same rotational direction as the first segment rotates relative to the first member, whereby the first and second segments collectively curl in a single direction.

3. The curling mechanism of claim 1 wherein:

the line between the first and second pivot axes defines a curling mechanism longitudinal axis;

said first cross member first attachment point is located on a first side of said curling mechanism longitudinal axis; and said first cross member second attachment point is located on a second and opposite side of said curling member longitudinal axis.

4. The curling mechanism of claim 1 further comprising:

a third segment rotatably attached to said second segment at a third pivot axis;

a second cross member rotatably attached to the first segment at a second cross member first attachment point, and also rotatably attached to the third segment at a second cross member second attachment point, the second cross member having a second cross member longitudinal axis defined by said two second cross member attachment points;

wherein rotational movement of the second segment relative to the first segment causes the second cross member to exert a rotational force on the third segment relative to the second segment, thereby causing the third segment to rotate relative to the second segment.

5. The curling mechanism of claim 4 wherein:

the rotational force exerted on the second segment by the first cross member causes the second segment to rotate relative to the first segment in the same rotational direction as the first segment rotates relative to the first member; and the rotational force exerted on the third segment by the second cross member causes the third segment to rotate relative to the second segment in the same rotational direction as the second segment rotates relative to the first segment;

whereby the first, second, and third segments collectively curl in a single direction.

6. The curling mechanism of claim 1 further comprising:

a simulated body of an aquatic creature;

a covering over the first and second segments, the cover simulating a skin of an appendage of the aquatic creature;

a power source and a drive motor disposed within the simulated body, and a coupling mechanism coupling the drive motor to the first segment to induce oscillation in the first segment;

whereby the curling mechanism simulates swimming movement of the simulated aquatic creature.

7. The curling mechanism of claim 6 wherein the simulated aquatic creature is an aquatic creature selected from the group consisting of a mermaid, a fish, a dolphin, and a whale.

8. A simulated aquatic creature comprising the curling mechanism of claim 1 disposed inside a simulated tail, a body section, and a power source for powering the curling mechanism in oscillatory movement.

9. A positioning structure comprising:

a plurality of interconnected segments, the plurality of segments having a longitudinal axis therethrough;

wherein each said segment is pivotally coupled to an adjacent segment at a respective pivot point, and is further connected to a non-adjacent segment by a respective control link; and wherein a relative angle between any two adjacent interconnected segments induces a similar relative angle between other ones of said interconnected segments by means of said control links, thus inducing a generally uniform curl throughout said interconnected segments.

10. The positioning structure of claim 9 wherein each control link has a first end and a second end, the first end being disposed on a first side of said longitudinal axis, the second end being disposed on a second and opposite side of said longitudinal axis, the two control link ends defining a longitudinal axis of the control link.

11. The positioning structure of claim 9 wherein each end of each respective control link is disposed offset, in a perpendicular direction from said longitudinal axis of said segments at a segment coupling point.

12. The positioning structure of claim 9 wherein:

each control link has first and second ends; and the second end of a first control link and the first end of a second control link are both disposed offset, in a perpendicular direction from said longitudinal axis at a segment coupling point.

13. The positioning structure of claim 9 wherein:

each control link has first and second ends;

the first end of a first control link and the first end of a second control link are both disposed on a first side of said longitudinal axis; and the second end of a first control link and the second end of a second control link are both disposed on a second and opposite side of said longitudinal axis.

14. The positioning structure of claim 9 wherein:

each control link has first and second ends;

the second end of a first control link is disposed on a first side of said longitudinal axis, and the first end of a second control link is disposed on a second and opposite side from said longitudinal axis; and a line between said second end of said first control link and said first end of said second control link defines a line that lies generally perpendicular to the longitudinal axis of said segments.

15. The positioning structure of claim 9 further comprising:

a flexible cover encompassing said interconnected segments and said control links, the flexible cover defining an outer shape and appearance to simulate part of a body of an aquatic creature.

16. The positioning structure of claim 9 further comprising:

a flexible skin encompassing said interconnected segments and said control links, the flexible cover defining an outer shape and appearance to simulate an appendage of a living thing.

17. The positioning structure of claim 9 further comprising:

a power source, a drive motor, and a coupling mechanism to provide an oscillatory movement to one of said segments, wherein said oscillatory movement of said positioning structure simulates body movement of an aquatic creature.

18. An apparatus for positioning a flexible appendage, said apparatus comprising:

a plurality of interconnected segments, the segments having a longitudinal axis collectively therethrough;

wherein a relative angle between any two adjacent said interconnected segments induces a similar such relative angle on at least one other said interconnected segment, by means of at least one respective control link; and wherein the relative angle between any two adjacent interconnected segments induces a similar relative angle between other ones of said interconnected segments by means of a plurality of control links, thus inducing a generally uniform curl throughout said interconnected segments.

19. The apparatus of claim 18 wherein said induced relative angle is caused by said control links connected between non-adjacent segments.

* * * * *